United States Patent [19]

Wiley

[11] 4,040,593

[45] Aug. 9, 1977

[54] PICTURE HANGING DEVICE

[75] Inventor: Kenneth Wiley, Coral Springs, Fla.

[73] Assignee: The Raymond Lee Organization, Inc., a part interest

[21] Appl. No.: 683,019

[22] Filed: May 4, 1976

[51] Int. Cl.[2] ..... A47G 1/16

[52] U.S. Cl. ..... 248/489; 248/291; 248/479

[58] Field of Search ..... 248/466, 475 R, 476, 248/479, 467, 489, 495, 496, 497, 498, 291; 308/189 R, 195, 193, 201, DIG. 7

[56] References Cited

U.S. PATENT DOCUMENTS

| | | | |
|---|---|---|---|
| 1,269,382 | 6/1918 | Butler | 248/467 |
| 1,496,282 | 6/1924 | Taylor | 248/467 |
| 3,097,898 | 7/1963 | Ferdig | 308/DIG. 7 |
| 3,224,821 | 12/1965 | Barr | 308/189 R X |
| 3,861,639 | 1/1975 | Morrill | 248/489 |

FOREIGN PATENT DOCUMENTS

| | | | |
|---|---|---|---|
| 120,567 | 7/1919 | United Kingdom | 308/201 |
| 102,456 | 12/1916 | United Kingdom | 248/498 |
| 1,186,856 | 4/1970 | United Kingdom | 308/201 |

*Primary Examiner*—Lawrence J. Staab

[57] ABSTRACT

A flat plate is attached to a wall upon which a picture is to be hung. A pedestal extends outwardly perpendicularly to the wall, and a circular lip with a convexly curved outer surface is attached to the outwardmost end of the pedestal. Ball bearings are located at regular intervals around the lip. A second flat plate is attached to the back of a picture, directly above the center of gravity of the picture. A flexible, circular hollow rim with a convex outer surface and a concave inner surface is attached to the second plate, and can be detachably secured over the lip.

2 Claims, 5 Drawing Figures

PICTURE HANGING DEVICE

SUMMARY OF THE INVENTION

This invention is designed to provide a device that will detachably secure a flat painting, picture or like work to a vertical wall, and which will allow the painting to reach a level equilibrium position, thus eliminating the frequent readjustments that are needed to keep conventionally hung paintings from tilting off level.

As will be seen hereafter, this invention provides a rotatable coupling that allows the painting to rotate in a vertical plane parallel to a wall. Because the device is located directly above the center of gravity of the work to be hung, the work will hang perfectly level. It is to be noted that the term "level", as ordinarily used, presupposes a work with a straight top edge that is exactly horizontally aligned. This invention is, however, contemplated for use with works of any shape that are designed to be hung upon a wall. In such cases, "level" can be taken to mean "properly aligned" with respect to the horizontal.

DETAILED DESCRIPTION OF PREFERRED EMBODIMENTS

Figure 1:
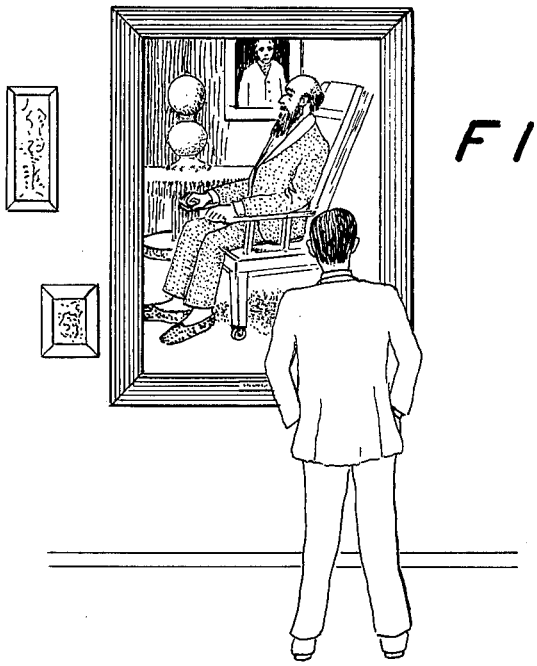
FIG. 1 shows a painting hung by use of the invention.
Figure 2:
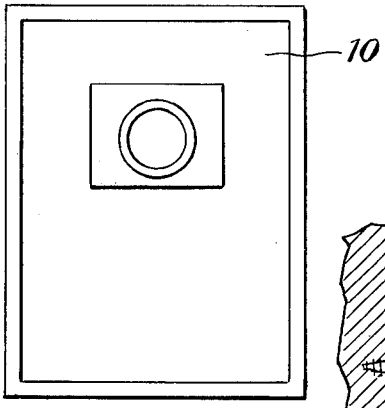
FIG. 2 shows the female portion of the invention mounted upon the back of a picture.
Figure 3:
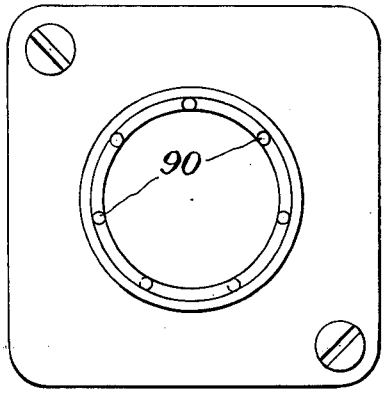
FIG. 3 shows the male portion of the invention.
Figure 4:
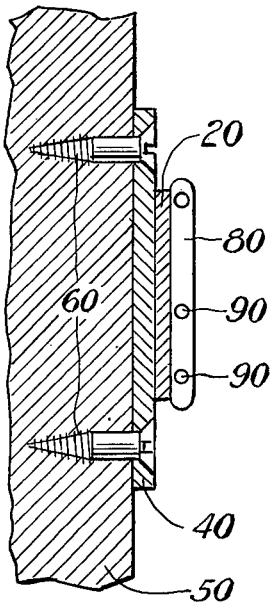
FIGS. 4 and 5 show side views of the male and female portions of the invention and how they connect together.
Figure 5:
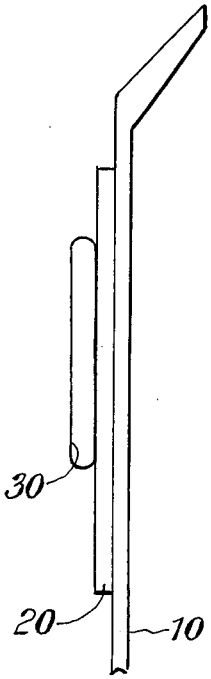

A picture 10 has a flat second plate 20 attached to its back. Attached to plate 20 is a flexible hollow rim 30. The rim has a convex outer surface and a concave inner surface.

A first plate 40 is attached to a vertical wall 50 by two screws 60. A pedestal 70 is attached to the plate 40 and extends outwardly away from it, perpendicularly to the wall. At the outwardmost end of the pedestal is a lip 80 that has a vertical plane, parallel to plate 40. At regular intervals around the lip are located a plurality of ball bearings 90. It can be seen that the rim can be detachably snapped over the lip and ball bearings, providing a connection that allows the picture to rotate in a vertical plane, parallel to the wall. If the center of the rim has been located directly above the center of gravity of the picture, the picture will rotate to a level equilibrium position.

It should be noted that any suitable method, such as glue, screws or nails can be used to secure the plates to their proper places.

While the invention has been described with particular reference to the drawings, the protection sought is to be limited only by the terms of the claims which follow.

I claim:

1. A device for hanging flat pictures upon a wall and maintaining the pictures in a level position, comprising:

a first flat plate attached to the wall;

a pedestal attached to the plate and extending outwardly away from it perpendicularly to the wall;

a circular lip located at the outwardmost end of the pedestal, the lip lying in a vertical plane and having a convexly curved outer surface;

a second flat plate attached to the back of a flat picture and located directly above the center of gravity of the picture; and a flexible circular hollow rim with a convex outer surface and a concave inner surface attached to the second plate, the rim occupying a plane parallel to the plane of the picture and detachably fitting over the lip so as to enable the picture to be secured parallel to the wall while being free to rotate parallel to the wall and thereby reach a level equilibrium position.

2. The device of claim 1 wherein a plurality of like ball bearings are located at regular intervals around the outer surface of the lip.

* * * * *